United States Patent [19]

Hodgson et al.

[11] Patent Number: 4,802,973

[45] Date of Patent: Feb. 7, 1989

[54] REMOVAL OF HYDROGEN SULPHIDE

[75] Inventors: Philip K. G. Hodgson, Walton-on-Thames; Julie A. McShea, Shepperton; Edward J. Tinely, Farnham, all of England

[73] Assignee: The British Petroleum Company p.l.c., London, England

[21] Appl. No.: 7,476

[22] Filed: Jan. 28, 1987

[30] Foreign Application Priority Data

Jan. 30, 1986 [GB] United Kingdom ..... 8602250

[51] Int. Cl.[4] ..... C10G 27/00

[52] U.S. Cl. ..... 208/207; 208/236; 208/237; 208/240; 423/244; 423/220; 423/224; 166/265; 175/64

[58] Field of Search ..... 423/244, 220, 224; 208/236, 237, 240; 166/224 R, 265, 267, 902, 300, 310; 175/64

[56] References Cited

U.S. PATENT DOCUMENTS

| | | | |
|---|---|---|---|
| 2,882,232 | 4/1959 | Haines et al. | 208/236 |
| 3,090,748 | 5/1963 | Guttner et al. | 208/40 |
| 3,258,421 | 6/1966 | Grutsch | 208/236 |
| 4,432,962 | 2/1984 | Gowdy et al. | 423/224 |
| 4,539,189 | 9/1985 | Starkston et al. | 423/220 |
| 4,569,766 | 2/1986 | Kool et al. | 210/690 |
| 4,647,397 | 8/1987 | Starkston et al. | 423/220 |
| 4,680,127 | 7/1987 | Edmondson | 423/243 |

*Primary Examiner*—Curtis R. Davis
*Assistant Examiner*—Helane Myers
*Attorney, Agent, or Firm*—Morgan & Finnegan

[57] ABSTRACT

Hydrogen sulphide is scavenged from a feedstock comprising crude oil and hydrogen sulphide by adding a compound of general formula:

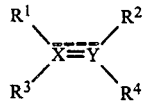

to the feedstock. X and Y are carbon or nitrogen atoms and the interatomic bond is triple or double as appropriate. Any two or more of $R^1$–$R^4$ are organic groups containing electronegative functional groups. The remaining two or less of $R^1$–$R^4$ are hydrocarbyl groups, hydrogen atoms or zero.

Preferred scavengers include di-isopropylazo dicarboxylate and dimethylacetylene dicarboxylate.

10 Claims, No Drawings

REMOVAL OF HYDROGEN SULPHIDE

This invention relates to a method for removing hydrogen sulphide from crude oil.

A petroleum reservoir is formed by a suitably shaped porous stratum of rock sealed with an impervious rock. The nature of the reservoir rock is extremely important as the oil is present in the small spaces or pores which separate individual rock grains.

Crude oil is generally found in a reservoir in association with water, which is often saline, and gas. Dependent upon the characteristics of the crude, the temperature and the pressure, the gas may exist in solution in the oil or additionally as a separate phase in the form of a gas cap. The oil and gas occupy the upper part of the reservoir and below there may be a considerable volume of water, known as the aquifer, which extends throughout the lower levels of the rock.

For oil to move through the pores of the reservoir rock and into a well, the pressure under which the oil exists in the reservoir must be greater than the pressure at the well.

The water contained in the aquifer is under pressure and is one source of drive. The dissolved gas associated with the oil is another and so is the free gas in the gas cap when this is present.

When oil is produced from a well, it is forced from the reservoir by natural pressure to the bottom of the well up which it rises to the surface. As the oil rises the pressure becomes less and gas associated with the oil is progressively released from solution.

After emerging from the well, it is necessary to treat the multi-phase mixture of oil, gas and possibly water, hereinafter termed "produced well fluid", in separators to remove free or potentially free gas, mainly methane and ethane. By potentially free gas is meant gas which would be likely to come out of solution if the oil were maintained at about atmospheric pressure, for example, during transport in a tanker or in storage tanks, without treatment.

Some crude oils contain not only dissolved hydrocarbon gases, but also appreciable quantities of hydrogen sulphide. This problem is particularly associated with "watered out" reservoirs approaching the end of their life, although it is not confined to them.

Hydrogen sulphide is a toxic, evil-smelling and corrosive gas and is unacceptable in quantity from both safety and environmental considerations. When hydrogen sulphide is present, it is necessary to provide further treatment to reduce the concentration of hydrogen sulphide in all products to an acceptably low level.

Much of the hydrogen sulphide associates with the gases resulting from the gas-oil separation process and this may be removed by scrubbing the gases, for example with amines. This requires expensive gas/liquid contacting, regeneration and conversion facilities. The cost of this extra treatment is considerable and in some cases, e.g., offshore fields, gas scrubbing may not be feasible since space may not be available on the field platforms for retrofitting the necessary equipment.

Even where gas scrubbing is possible, this still leaves some hydrogen sulphide associated with the oil and aqueous phases, however.

It would clearly be more convenient to treat the produced well fluid with a scavenger for hydrogen sulphide before the various phases are separated.

We have now discovered that certain unsaturated compounds containing electronegative groups are capable of reacting with hydrogen sulphide under mixed phase conditions and forming relatively harmless thiol compounds.

Thus according to the present invention there is provided a method of scavenging hydrogen sulphide from a feedstock comprising crude oil and hydrogen sulphide which method comprises adding a compound of general formula:

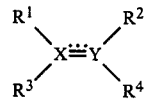

where X and Y are carbon or nitrogen atoms and the interatomic bond is triple or double as appropriate, any two or more of $R^1$–$R^4$ are separate organic groups containing electronegative functional groups, the remaining two or less of $R^1$–$R^4$ are hydrocarbyl groups, hydrogen atoms, or zero when X and Y are carbon atoms and the interatomic bond is double or triple, or when X and Y are nitrogen atoms and the interatomic bond is double, the groups when present being either separate groups or joined together to form a ring structure, to the feedstock and allowing the compound to react with the hydrogen sulphide contained therein.

The preferred electronegative functional groups are of formula

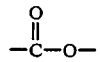

Compounds incorporating this group in their structure include esters and carboxylic anhydrides.

Other suitable electronegative functional groups include ketonic, amino and nitrilic groups.

Suitable hydrocarbyl groups include alkyl groups containing 1 to 18, preferably 1 to 4 carbon atoms, aryl groups and alkyl aryl groups wherein the alkyl moiety contains 1 to 18, preferably 1 to 4, carbon atoms.

The feedstock may be produced well fluid as hereinbefore defined.

Although the above defined scavengers are particularly useful in treating produced well fluids since they can withstand the severe environments of the latter, they are also suitable for treating crude oil or petroleum fractions under milder conditions, for example in pipelines, storage tanks, railcars, tankers etc, after the well fluid has been dewatered and degassed.

When water is present, the partitioning of hydrogen sulphide between the various phases depends largely upon the pH and redox potential of the aqueous phase. These will normally be such that the hydrogen sulphide is concentrated in the oil and aqeuous phases, i.e. in the ranges 4 to 9.5 and −0.2 to −0.3 v with reference to hydrogen potential, respectively.

Preferably the scavengers are oil soluble and react with the hydrogen sulphide in the oil phase. By mass transfer this also reduces the concentration of hydrogen sulphide in the gaseous and aqueous phases. The oil soluble scavengers should also be stable in the presence of water and thermally stable since well fluids are often produced at elevated temperature.

Preferred scavengers include unsaturated dicarboxylates such as

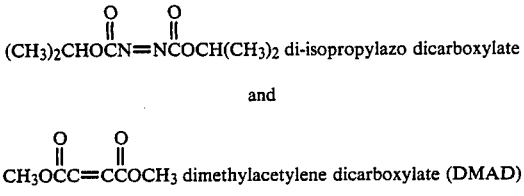

$(CH_3)_2CHOC(=O)N=NC(=O)OCH(CH_3)_2$ di-isopropylazo dicarboxylate and $CH_3OC(=O)C\equiv CC(=O)OCH_3$ dimethylacetylene dicarboxylate (DMAD)

Other suitable scavengers

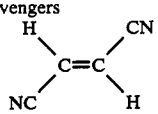

fumaronitrile and

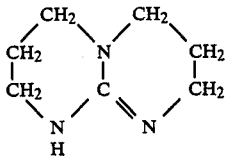

1,5,7-triazabicyclo[4.4.0]dec-5-ene

The scavenger compound is suitably used in amount 1 to 50, preferably 5 to 15, times the amount of hydrogen sulphide present, on a molar basis.

The length of time required to scavenge the hydrogen sulphide is generally of the order of 1 to 15 minutes.

The invention is illustrated with reference to the following Examples.

EXAMPLES 1-5

A flask was charged with 30 g crude oil (from the Welton oil field in the English Midlands) and 8 g water, buffered to a pH of 7 and sealed. 2 ml of 0.7% $Na_2S.9H_2O$ were then injected by means of a syringe, giving a potential $H_2S$ content of 0.02 g.

The resulting oil/aqueous liquid/gas system was allowed to equilibrate for 15 minutes after which in Examples 2-5 the scavenger was injected in solution or neat liquid form into the flask and the latter was shaken.

After a further 15 minutes, except in the case of Example 4 where the time was 24 hours, a sample of the gas was removed to a "Gas-Tec" detection tube and the hydrogen sulphide concentration was determined. The following results were obtained:

| Example | Scavenger | Concentration of $H_2S$ (ppm) |
|---|---|---|
| 1 | Control (No additive) | 700 |
| 2 | Di-isopropylazodicarboxylate (0.1 ml neat) | 10-20 |
| 3 | Fumaronitrile (0.1 g in 1 g toluene) | 180 |
| 4 | "DMAD" (0.1 ml neat) | 10 |

EXAMPLES 6-8

50 g crude oil (from the Nettleham B reservoir in the English Midlands) and 10 g distilled water were sparged with gaseous hydrogen sulphide and introduced into an autoclave. In Example 6, no scavenger was added. In Examples 7 and 8, scavenger was added in the amounts specified. The autoclave was sealed and allowed to equilibrate for a specified time at a desired temperature. The gas above the oil/aqueous phase was then withdrawn and bubbled slowly through a known volume of 3% borax solution.

The autoclave was then charged to 5 bar pressure with nitrogen. This action sparged more hydrogen sulphide from the oil/aqueous phase. After 5 minutes the gas above the oil/aqueous phase was withdrawn and bubbled through the same borax solution. The amount of hydrogen sulphide collected in the borax as $SH^-$ and $S^{2-}$ ions was determined by standard iodine titrations.

The amount of hydrogen sulphide recovered was then compared with the amount introduced.

The following results were obtained.

| Ex | Temp °C. | Scavenger | pH of Aqueous Phase | $H_2S$ Introduced (g) | Equilibration Time (hours) | $H_2S$ Recovered (% by wt) |
|---|---|---|---|---|---|---|
| 5 | 60 | None | 2 | 0.072 | 2 | 56.5 |
| 6 | 60 | Dimethylmaleate (0.35 g) | 2 | 0.072 | 2 | 44 |

We claim:

1. A method for scavenging hydrogen sulphide from a feedstock comprising crude oil and hydrogen sulphide which method comprises treating the feedstock with a reactant consisting essentially of a compound of general formula

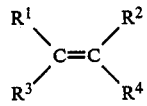

where any two or more of $R^1$-$R^4$ are separate organic groups containing electronegative functional groups selected from the group consisting of ketonic, amino, nitrilic and

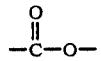

groups, and the remaining two or less of $R^1$-$R^4$ are hydrocarbyl groups, or hydrogen atoms and wherein the hydrocarbyl groups, when present, are selected from the group consisting of alkyl groups containing 1 to 18 carbon atoms, aryl groups and alkyl aryl groups wherein the alkyl moiety contains 1 to 18 carbon atoms, and reacting the compound in the liquid phase with the hydrogen sulphide contained therein, the compound being used in amount 1 to 50 times the amount of hydrogen sulphide present, on a molar basis.

2. A method for scavenging hydrogen sulphide from a feedstock comprising crude oil and hydrogen sulphide which method comprises treating the feedstock with a reactant consisting essentially of a compound of general formula $R^1—C{=}C—R^2$ where $R^1$ and $R^2$ are separate organic groups containing electronegative functional groups selected from the group consisting of ketonic, amino, nitrilic and

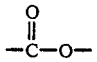

groups, and reacting the compound in the liquid phase with the hydrogen sulphide contained therein, the compound being used in amount 1 to 50 times the amount of hydrogen sulphide present, on a molar basis.

3. A method according to claim 2 wherein the compound is dimethylacetylene dicarboxylate.

4. A method for scavenging hydrogen sulphide from a feedstock comprising crude oil and hydrogen sulphide which method comprises treating the feedstock with a reactant consisting essentially of a compound of general formula $R^1—N=N—R^2$ where $R^1$ and $^2$ are separate organic groups containing electronegative functional groups selected from the group consisting of ketonic, amino, nitrilic and

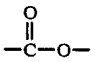

groups, and reacting the compound in the liquid phase with the hydrogen sulphide contained therein, the compound being used in amount 1 to 50 times the amount of hydrogen sulphide present, on a molar basis.

5. A method according to claim 4 wherein the compound is di-isopropylazo dicarboxylate.

6. A method for scavenging hydrogen sulphide from a feedstock comprising crude oil and hydrogen sulphide which method comprises treating the feedstock with a reactant consisting essentially of a compound of general formula

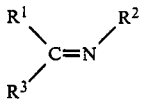

where at least two of $R^1$–$R^3$ are organic groups containing electronegative functional groups selected from the group consisting of ketonic, amino, nitrilic and

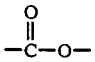

groups, and the remaining one, if present, is a and the remaining one, if present, is a hydrocarbyl group, or a hydrogen atom and wherein the hydrocarbyl group, when present, is selected from the group consisting of alkyl groups containing 1 to 18 carbon atoms, aryl groups or alkyl aryl groups wherein the alkyl moiety contains 1 to 18 carbon atoms, the groups when present being either separate groups or joined together to form a ring structure, and reacting the compound in the liquid phase with the hydrogen sulphide contained therein, the compound being used in amount 1 to 50 times the amount of hydrogen sulphide present, on a molar basis.

7. A method according to claim 1, 2, 4, or 6 wherein the compound is an unsaturated dicarboxylate.

8. A method according to claim 1, 2, 4 or 6 wherein the feedstock is produced well fluid.

9. A method according to claim 1, 2, 4 or 6 wherein the feedstock is dewatered or degassed crude petroleum.

10. A method according to claim 1, 2, 4 or 6 wherein the compound is used in amount 5 to 15 times the amount of hydrogen sulphide present, on a molar basis.

* * * * *

UNITED STATES PATENT AND TRADEMARK OFFICE

CERTIFICATE OF CORRECTION

PATENT NO. : 4,802,973

DATED : February 7, 1989

INVENTOR(S) : PHILIP K.G. HODGSON: JULIE A. McSHEA AND EDWARD J. TINELY

It is certified that error appears in the above-identified patent and that said Letters Patent is hereby corrected as shown below:

Claim 6, lines 15 and 16, after "one," (first occurrence) delete "if present, is a and the remaining one,".

Signed and Sealed this

Ninth Day of January, 1990

*Attest:*

JEFFREY M. SAMUELS

*Attesting Officer*

*Acting Commissioner of Patents and Trademarks*